US007549949B2

(12) United States Patent
Webber et al.

(10) Patent No.: US 7,549,949 B2
(45) Date of Patent: Jun. 23, 2009

(54) CHEST PRESS EXERCISE MACHINE WITH SELF-ALIGNING PIVOTING USER SUPPORT

(75) Inventors: Randall T. Webber, La Jolla, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 11/846,437

(22) Filed: Aug. 28, 2007

(65) Prior Publication Data

US 2007/0293378 A1 Dec. 20, 2007

Related U.S. Application Data

(63) Continuation-in-part of application No. 10/633,805, filed on Aug. 4, 2003.

(60) Provisional application No. 60/824,575, filed on Sep. 5, 2006.

(51) Int. Cl.
*A63B 21/06* (2006.01)

(52) U.S. Cl. ..... 482/99; 482/100; 482/137; 482/96

(58) Field of Classification Search ..... 482/42, 482/92, 93, 95, 96, 97–100, 137
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 3,446,503 | A | 5/1969 | Lawton |
| 3,592,465 | A | 7/1971 | Fulkerson, Jr. |

(Continued)

FOREIGN PATENT DOCUMENTS

| | | |
|---|---|---|
| CA | 2075331 | 2/1994 |

(Continued)

OTHER PUBLICATIONS

U.S. Appl. No. 11/846,459, filed Aug. 2007, Webber et al.

(Continued)

*Primary Examiner*—Jerome Donnelly
(74) *Attorney, Agent, or Firm*—Procopio, Cory Hargreaves & Savitch LLP

(57) ABSTRACT

A chest press exercise machine has a self-aligning pivoting user support on a main frame and an exercise arm which is linked to the pivoting user support to translate movement of the exercise arm into movement of the user support. A user support pivot which may be a single pivot, floating pivot link, or four-bar pivot linkage arrangement pivotally connects the user support to the main frame. A connecting link is movably associated with the user engagement device or exercise arm and at least one of the main frame, user support, or user support pivot. The user support pivot is positioned so that part of the combined weight of the user and user support is positioned on both sides of the gravitational centerline throughout the exercise movement and a portion of the combined weight passes through the centerline to redistribute the weight as the exercise arm is moved.

24 Claims, 7 Drawing Sheets

U.S. PATENT DOCUMENTS

| | | | | |
|---|---|---|---|---|
| 3,640,528 | A | 2/1972 | Proctor | |
| 3,707,285 | A | 12/1972 | Martin | |
| 4,004,801 | A | 1/1977 | Campanaro et al. | |
| 4,111,414 | A | 9/1978 | Roberts | |
| 4,231,568 | A | 11/1980 | Riley et al. | |
| 4,300,760 | A | 11/1981 | Bobroff | |
| 4,441,708 | A | 4/1984 | Brentham | |
| 4,632,390 | A | 12/1986 | Richey | |
| 4,641,833 | A | 2/1987 | Trethewey | |
| 4,700,946 | A | 10/1987 | Breunig | |
| 4,743,010 | A | 5/1988 | Geraci | |
| 4,793,608 | A | 12/1988 | Mahnke et al. | |
| 4,822,038 | A | 4/1989 | Maag | |
| 4,844,456 | A | 7/1989 | Habing et al. | |
| 4,911,438 | A | 3/1990 | Van Straaten | |
| 4,944,641 | A | 7/1990 | Habing | |
| 4,949,951 | A | 8/1990 | Deola | |
| 4,949,958 | A | 8/1990 | Richey | |
| 5,100,128 | A | 3/1992 | Mabry | |
| 5,106,081 | A | 4/1992 | Webb | |
| 5,108,095 | A | 4/1992 | Nichols | |
| 5,236,406 | A | 8/1993 | Webber | |
| 5,250,013 | A | 10/1993 | Brangi | |
| 5,254,067 | A | 10/1993 | Habing et al. | |
| 5,263,914 | A | 11/1993 | Simonson et al. | |
| 5,267,930 | A | 12/1993 | Henes | |
| 5,299,997 | A | 4/1994 | Chen | |
| 5,322,489 | A | 6/1994 | Webb | |
| 5,330,404 | A | 7/1994 | Lopeteguy et al. | |
| 5,330,405 | A | 7/1994 | Habing et al. | |
| 5,334,120 | A | 8/1994 | Rasmussen | |
| 5,342,269 | A | 8/1994 | Huang et al. | |
| 5,346,447 | A | 9/1994 | Stearns | |
| 5,352,171 | A | 10/1994 | Lin | |
| 5,354,248 | A | 10/1994 | Rawls et al. | |
| 5,356,357 | A | 10/1994 | Wang et al. | |
| 5,356,358 | A | 10/1994 | Chen | |
| D357,041 | S | 4/1995 | McBride et al. | |
| 5,417,634 | A | 5/1995 | Habing | |
| 5,421,796 | A | 6/1995 | Jones et al. | |
| 5,437,589 | A | 8/1995 | Habing | |
| 5,447,480 | A | 9/1995 | Fulks | |
| 5,453,066 | A | 9/1995 | Richter, Jr. | |
| 5,458,553 | A | 10/1995 | Wu | |
| 5,478,298 | A | 12/1995 | Chen | |
| 5,499,959 | A | 3/1996 | Holmes et al. | |
| 5,503,608 | A | 4/1996 | Chang | |
| 5,507,710 | A | 4/1996 | Chen | |
| 5,520,599 | A | 5/1996 | Chen | |
| 5,527,243 | A | 6/1996 | Chen | |
| 5,527,249 | A | 6/1996 | Harris | |
| 5,533,953 | A | 7/1996 | Lui et al. | |
| 5,540,639 | A | 7/1996 | Potts et al. | |
| D372,509 | S | 8/1996 | Yang | |
| 5,547,444 | A | 8/1996 | Huang et al. | |
| 5,549,530 | A | 8/1996 | Fulks | |
| 5,554,086 | A | 9/1996 | Habing et al. | |
| 5,562,577 | A | 10/1996 | Nichols et al. | |
| 5,573,482 | A | 11/1996 | Wang et al. | |
| 5,580,340 | A * | 12/1996 | Yu | 482/96 |
| 5,580,341 | A | 12/1996 | Simonson | |
| 5,582,563 | A * | 12/1996 | Fan | 482/96 |
| 5,603,678 | A | 2/1997 | Wilson | |
| 5,626,542 | A | 5/1997 | Dalebout et al. | |
| 5,643,147 | A | 7/1997 | Huang | |
| 5,643,152 | A | 7/1997 | Simonson | |
| 5,658,227 | A | 8/1997 | Stearns | |
| 5,669,865 | A | 9/1997 | Gordon | |
| 5,672,142 | A | 9/1997 | Wu | |
| 5,674,161 | A | 10/1997 | Lin | |
| 5,676,626 | A | 10/1997 | Huang | |
| 5,683,334 | A | 11/1997 | Webber | |
| 5,695,434 | A | 12/1997 | Dalebout et al. | |
| 5,702,328 | A | 12/1997 | Mansvelt | |
| 5,720,695 | A | 2/1998 | Eckmann | |
| 5,722,918 | A | 3/1998 | Lee | |
| 5,733,229 | A | 3/1998 | Dalebout et al. | |
| 5,733,232 | A | 3/1998 | Hsu | |
| 5,749,813 | A | 5/1998 | Domzalski | |
| 5,803,882 | A | 9/1998 | Habling et al. | |
| 5,810,698 | A | 9/1998 | Hullett et al. | |
| 5,810,701 | A | 9/1998 | Ellis et al. | |
| 5,827,158 | A | 10/1998 | Drecksel | |
| 5,876,095 | A | 3/1999 | Johnston | |
| 5,899,836 | A * | 5/1999 | Chen | 482/92 |
| 5,906,564 | A | 5/1999 | Jacobsen | |
| 5,938,570 | A | 8/1999 | Maresh | |
| 5,938,571 | A | 8/1999 | Stevens | |
| 5,944,641 | A | 8/1999 | Habing | |
| 5,961,427 | A | 10/1999 | Habing et al. | |
| 5,967,954 | A | 10/1999 | Habling | |
| 5,989,165 | A | 11/1999 | Gianelli et al. | |
| 5,997,446 | A | 12/1999 | Stearns | |
| 5,997,447 | A | 12/1999 | Gianelli et al. | |
| 6,004,247 | A | 12/1999 | Webber | |
| 6,024,677 | A | 2/2000 | Siwertz | |
| 6,071,216 | A | 6/2000 | Gianelli et al. | |
| 6,074,328 | A | 6/2000 | Johnson | |
| 6,080,091 | A | 6/2000 | Habing et al. | |
| 6,086,521 | A | 7/2000 | Solland | |
| 6,142,917 | A | 11/2000 | Gianelli et al. | |
| 6,152,864 | A | 11/2000 | Gianelli et al. | |
| 6,162,153 | A | 12/2000 | Perez et al. | |
| 6,244,995 | B1 | 6/2001 | Prsala | |
| 6,251,047 | B1 | 6/2001 | Stearns et al. | |
| 6,264,588 | B1 * | 7/2001 | Ellis | 482/137 |
| 6,302,832 | B1 | 10/2001 | Stearns | |
| 6,312,366 | B1 | 11/2001 | Prusick | |
| 6,387,020 | B1 | 5/2002 | Simonson | |
| 6,394,937 | B1 | 5/2002 | Voris | |
| 6,491,609 | B2 | 12/2002 | Webber | |
| 6,605,024 | B2 * | 8/2003 | Stearns | 482/142 |
| 6,676,577 | B2 | 1/2004 | Stearns | |
| 6,752,748 | B1 * | 6/2004 | Scotti | 482/140 |
| 6,811,522 | B1 | 11/2004 | McQuinn | |
| 6,855,098 | B2 | 2/2005 | Reitz et al. | |
| 6,916,278 | B2 | 7/2005 | Webber | |
| 6,966,872 | B2 | 11/2005 | Eschenbach | |
| 6,971,978 | B2 | 12/2005 | Hyder | |
| 7,052,444 | B2 | 5/2006 | Webber | |
| 7,052,446 | B2 | 5/2006 | Morris et al. | |
| 7,070,545 | B2 | 7/2006 | Lull et al. | |
| 7,141,003 | B2 | 11/2006 | Wu | |
| 7,141,008 | B2 | 11/2006 | Krull et al. | |
| 7,220,221 | B2 | 5/2007 | Mosimann et al. | |
| 7,223,213 | B2 | 5/2007 | Golesh | |
| 7,229,389 | B2 | 6/2007 | Hong | |
| 7,322,906 | B2 | 1/2008 | Webber | |
| 7,331,911 | B2 * | 2/2008 | Webber et al. | 482/137 |
| 7,335,140 | B2 * | 2/2008 | Webber et al. | 482/98 |
| 7,361,125 | B2 | 4/2008 | Webber et al. | |
| 7,384,381 | B2 | 6/2008 | Webber et al. | |
| 7,468,024 | B2 | 12/2008 | Webber et al. | |
| 2002/0103058 | A1 | 8/2002 | Webber | |
| 2002/0187879 | A1 | 12/2002 | Ball et al. | |
| 2003/0199362 | A1 | 10/2003 | Chamberlin | |
| 2005/0032611 | A1 | 2/2005 | Webber et al. | |
| 2005/0096196 | A1 | 5/2005 | Webber et al. | |
| 2005/0096197 | A1 | 5/2005 | Webber et al. | |
| 2005/0096198 | A1 | 5/2005 | Webber et al. | |
| 2006/0211549 | A1 | 9/2006 | Nohejl | |
| 2006/0247107 | A1 | 11/2006 | Carter | |
| 2006/0276313 | A1 | 12/2006 | Hong | |
| 2007/0232462 | A1 | 10/2007 | Webber et al. | |

| | | | |
|---|---|---|---|
| 2007/0293377 | A1 | 12/2007 | Webber et al. |
| 2007/0293378 | A1 | 12/2007 | Webber et al. |
| 2008/0058176 | A1 | 3/2008 | Webber et al. |
| 2008/0132389 | A1 | 6/2008 | Webber et al. |
| 2008/0153677 | A1 | 6/2008 | Webber et al. |
| 2008/0182732 | A1 | 7/2008 | Webber et al. |
| 2008/0234110 | A1 | 9/2008 | Webber et al. |
| 2008/0248929 | A1 | 10/2008 | Webber et al. |

FOREIGN PATENT DOCUMENTS

| | | | |
|---|---|---|---|
| SU | 1674874 | A1 | 9/1991 |

OTHER PUBLICATIONS

U.S. Appl. No. 11/849,028, filed Aug. 2007, Webber et al.
U.S. Appl. No. 11/848,012, filed Aug. 2007, Webber et al.
U.S. Appl. No. 11/846,472, filed Aug. 2007, Webber et al.
Boss Fitness Brochure, 1993.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure.
Pace, 318 Dip/Shrug, Hanley International Brochure.
FA-508 Dip Machine, Flex Brochure.
Sprint by Hogan Industries.
Models 217 and 206-2, Polaris Brochure.
Hoist Selectionized Duals HD Series, Hoist Brochure, 2002.
Gravity Gym Instruction Manual, Seated Bench Press.
Seated Close Grip Bench Press, Gravity Gym Instruction Manual.
Vertical Bench Press Machine, Hoist Brochure, 1993.
Sprint by Hogan Industries, Linear Motion Chest Press.
Chest Press and Incline Press, plate-loaded, Cybex Brochure, 1996.
Leg Press Machine, Schwinn Natural Strength, European trade magazine.
Low Back Machine, Hoist Brochure, HS1225, 2005.
How It Works Flyer, illustration of exercises performed on U.S. Patent No. 5,527,249 of Harris.
Sprint Circuit, Hogan Industries Brochure.
Notice of Allowance of Nov. 30, 2007 in U.S. Appl. No. 10/698,908.
Office Action of Aug. 10, 2007 in U.S. Appl. No. 10/698,908.
Office Action of Nov. 14, 2006 in U.S. Appl. No. 10/698,908.
Office Action of Apr. 6, 2007 in U.S. Appl. No. 10/699,995.
Office Action of Oct. 1, 2007 in U.S. Appl. No. 10/633,805.
Office Action of Dec. 21, 2006 in U.S. Appl. No. 10/633,805.
Office Action of Nov. 6, 2006 in U.S. Appl. No. 10/699,992.
Notice of Allowance of Nov. 30, 2007 in U.S. Appl. No. 10/699,992.

* cited by examiner

CHEST PRESS EXERCISE MACHINE WITH SELF-ALIGNING PIVOTING USER SUPPORT

RELATED APPLICATION

The present application claims the benefit of U.S. provisional patent application No. 60/824,575 filed Sep. 5, 2006, which is incorporated herein by reference in its entirety, and is a Continuation-In-Part of co-pending U.S. patent application Ser. No. 10/633,805 filed on Aug. 4, 2003, which is also incorporated herein by reference in its entirety.

BACKGROUND

1. Field of the Invention

This invention relates generally to an exercise machine with a self-aligning pivoting user support, and is particularly concerned with a chest press exercise machine.

2. Related Art

A chest press is a compound exercise movement. There are two basic types of exercise movement, isolation and compound. Isolation exercises are designed to isolate a single muscle or muscle group and reduce body part movement to rotation of a single joint. Leg extensions and biceps curls are examples of isolation exercises. Compound movement involves more than one body part and requires multiple joint action. Chest press exercises are an example of a compound exercise movement.

Chest press exercise machines attempt to reproduce the exercise movement of a free weight chest press exercise using a barbell or dumbbell. One problem is the unnatural and exaggerated arcing movement often found in such machines, which often do not accurately simulate the natural body movement found in a free weight exercise.

SUMMARY

In one aspect, an exercise machine has a pivoting seat or user support on a main frame and an exercise arm for performing chest press exercises which is linked to the pivoting user support to translate movement of the exercise arm into movement of the user support. A pivoting mechanism which pivotally connects the user support to the main frame is designed to automatically align in order to maintain proper positioning of the user throughout the exercise motion. The linkage between the exercise arm movement and movement of the user support is configured to produce a slight arcing motion, similar to that of a free weight barbell or dumbbell exercise. The exercise machine may be designed for performing decline press, bench press, or incline press exercises. The movement of the user engagement device or exercise arm may be rotational or linear, and is linked to the user support to cause rotational movement of the user support.

The user support is linked to the exercise arm so that movement in the arm forces self-aligning movement in the user support, which is continuous throughout the exercise range of motion. By linking the movement of the user support to that of the exercise arm, this design provides the user with a more comfortable exercise movement that mimics the natural alignment in both the starting and finishing positions when performing a chest press exercise.

In this machine, the user engagement means travels separately from the user support, but movement of the user support is dependent on and linked to the movement of the user engagement means. Movement of the user engagement means may be rotational or may be in a linear exercise path, as described in pending U.S. patent application Ser. No. 10/633,805 entitled "Self-Aligning Pivoting Seat Exercise Machine" which was filed on Aug. 4, 2003, the contents of which are incorporated herein by reference.

In one embodiment, the user support has a primary support or seat and at least one secondary user support for supporting another part of the user's body, such as the back or feet. The secondary support and seat may be in fixed alignment to each other and travel together through the same range of motion and rotate together about the same pivot point.

The user support pivot may be a single pivot, or may be a four bar pivot linkage which defines a theoretical pivot about which the user support rotates. A four bar pivot linkage beneath the user support can be arranged to produce movement equivalent to a single pivot at an inaccessible location, for example where it would interfere with the user's body or user support during an exercise movement.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a chest press exercise machine with a self-aligning pivoting seat or user support.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
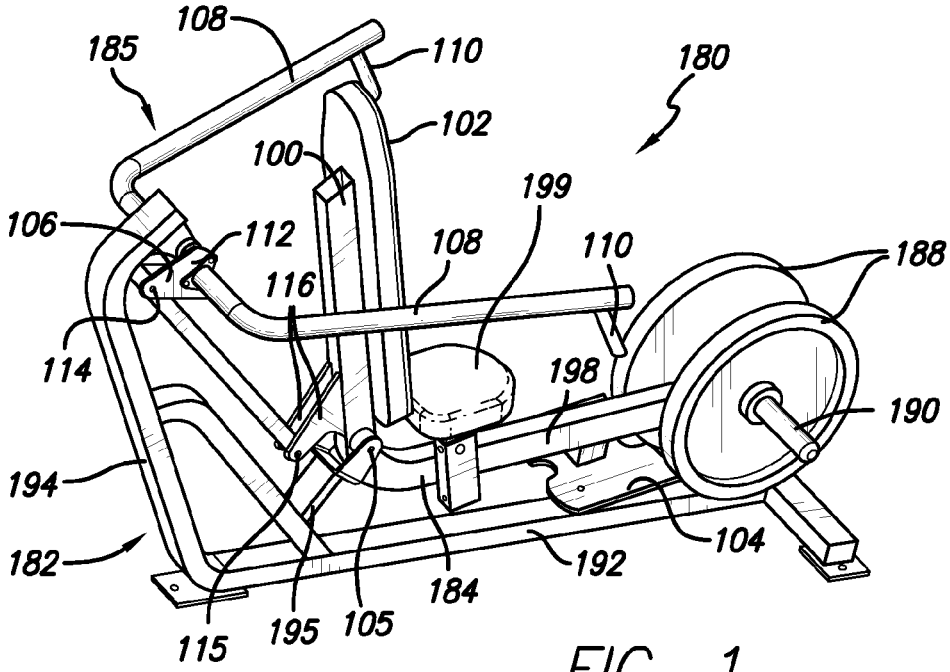
FIG. 1 is a rear perspective view of a chest press exercise machine according to a first embodiment, with the machine in a start position at a beginning of an exercise movement.
Figure 2:
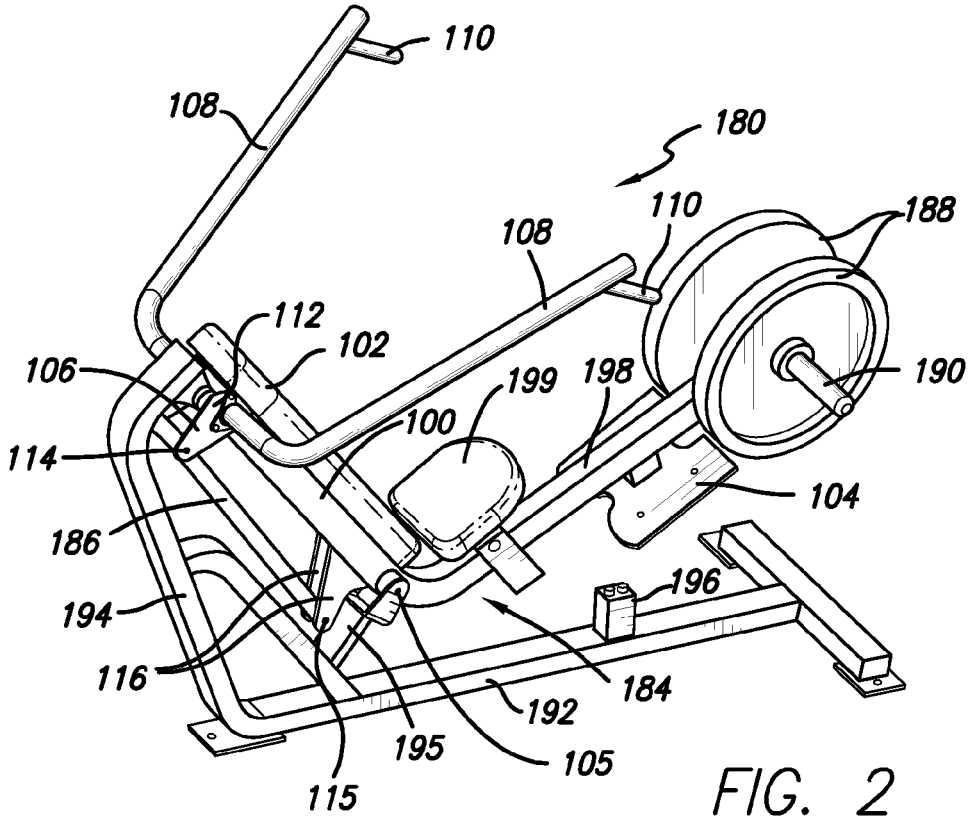
FIG. 2 is a rear perspective view similar to FIG. 1, illustrating the machine in an exercise end position.
Figure 3:
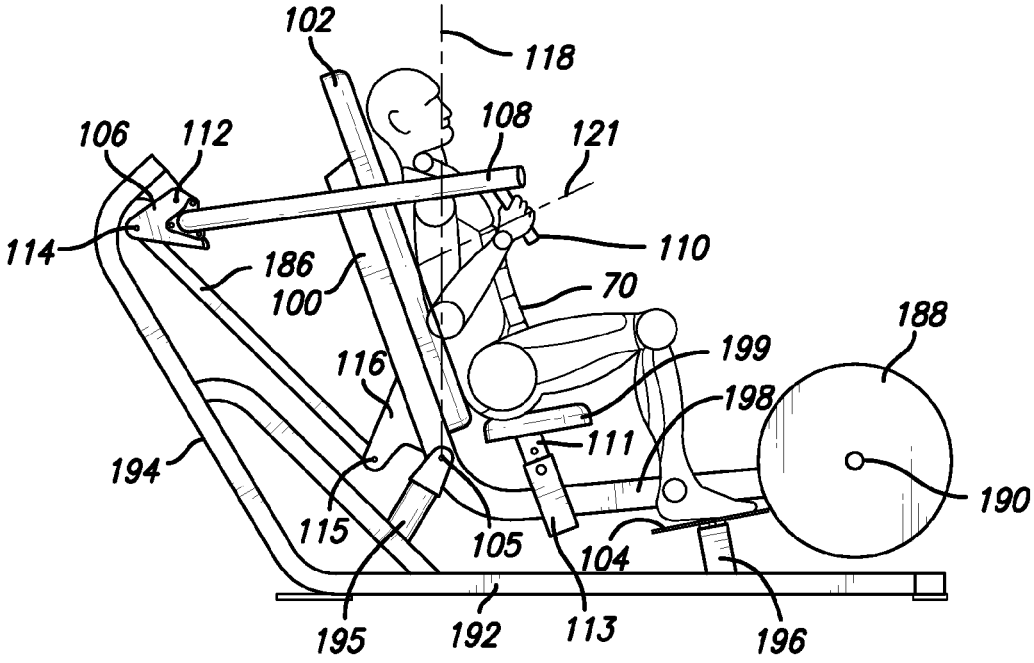
FIG. 3 is a side elevation view of the exercise machine in the start position of FIG. 1, illustrating an exerciser seated on the user support and ready to begin an exercise.
Figure 4:
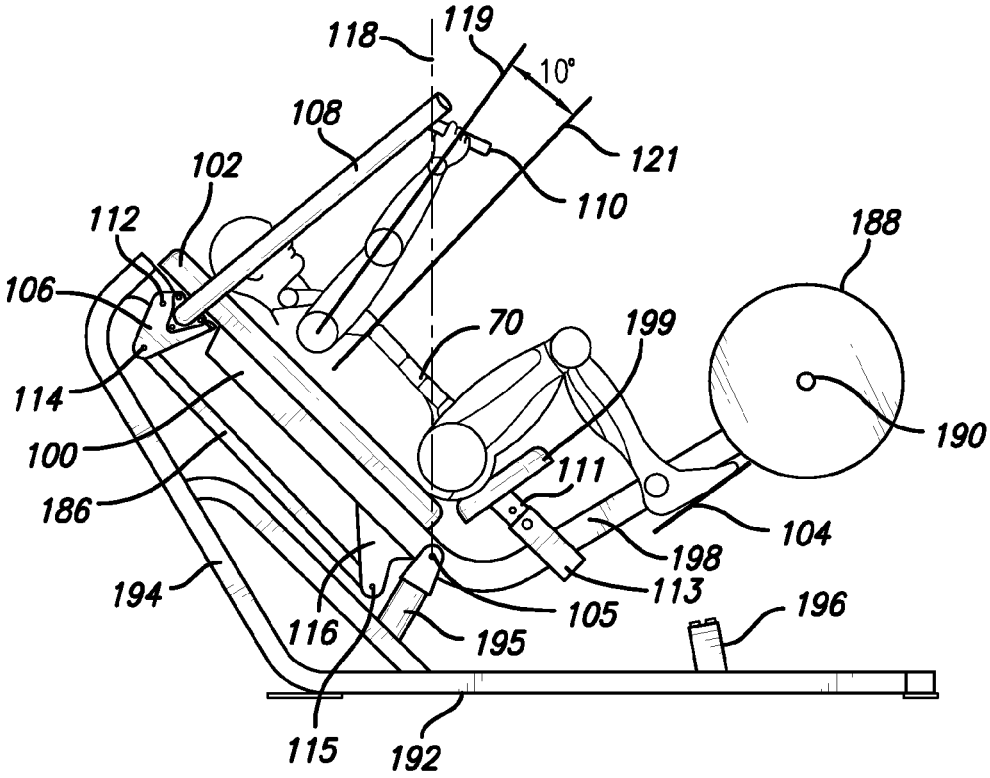
FIG. 4 is a side elevation view of the exercise machine in the end position of FIG. 2 with an exerciser seated on the user support.

FIGS. 1 to 4 illustrate a first chest press exercise machine 180, with FIGS. 1 and 2 illustrating the machine in an exercise start and end position, respectively, and FIGS. 3 and 4 illustrating an exerciser 70 seated on the machine in the start and end position of a chest press exercise. The chest press machine 180 substantially duplicates the movement carried out by an exerciser performing a free weight chest press or bench press, but the exercise may be easier and more comfortable since the user's movement is guided while the user's body is fully supported throughout the exercise.

The machine 180 basically comprises a main frame 182, a user support frame 184 pivotally mounted on the main frame, an exercise arm 185 also pivotally mounted on the main frame, a connecting link 186 between the exercise arm and the user support frame, and an exercise resistance, which in this case comprises weight plates 188 mounted on weight receiving pegs 190 at the forward end of the user support frame. The main frame 182 has a base 192, a rearwardly inclined upright 194, and a user support pivot mount 195. A stop post 196 on the base supports the user support frame in the start position.

The user support frame 184 is generally L-shaped with a base 198 on which a seat pad 199 is adjustably mounted, and an upright 100 on which a back pad 102 is mounted. Seat pad 199 is adjustably mounted via a strut or post 111 which is telescopically mounted in adjuster tube 113 mounted on base 198, so that the height of the seat pad 199 can be adjusted for different users. A footrest or foot plate 104 is secured beneath the base at an appropriate position and orientation for supporting the feet of a user seated on the seat pad. The weight plates 188 are positioned forward of the footrest 104. The frame 184 is pivotally supported on the pivot mount of the main frame for rotation about pivot axis 105.

The exercise arm 185 comprises a U-shaped member with a central section pivoted to the upper end of the upright 194 via pivot bracket 106, and opposite arms 108 extending on opposite sides of the user support. A pair of downwardly directed handles 110 are mounted at the forward ends of handle arms 108 for gripping by a user with their hands in a suitable orientation for performing a chest press exercise. Pivot bracket 106 is pivoted at one position to the upper end of upright 194 via pivot 112, and at another position to the upper end of connecting link 186, via pivot 114, as best illustrated in FIGS. 3 and 4. The lower end of the connecting link is pivoted via pivot 115 to a pivot bracket 116 at the lower end of the user support upright 100, so that upward rotational movement of the exercise arm results in rearward rotational movement of the user support.

In an alternative arrangement, a single or two-part exercise arm may be adjustable in order to vary the start position for user's with different arm lengths. The bracket or plate 106 may be replaced with one or two range-of-motion or ROM plates, and each exercise arm may be releasably secured to the ROM plate, at a selected angular position. In this case, the arm will be pivoted to the ROM plate, which has a series of spaced openings extending in a part circular path. The arm is secured at a selected angular orientation relative to the plate by a releasable push pin or the like extending through a selected opening. A ROM arrangement for an adjustable exercise arm is described, for example, in U.S. Pat. No. 6,090,020 of Webber, the contents of which are incorporated herein by reference.

FIGS. 3 and 4 illustrate a user 70 performing a chest press exercise on the machine 180. The user first sits on the seat in the start position of FIG. 3, resting their feet on footrest 104 and grabbing the handles 110 with their hands. Handles 110 are positioned in front of back pad and proximate the front of the user's chest in the start position of FIG. 3. The user starts the exercise in a slightly reclined position, with their hands slightly below their shoulders and slightly in front of, and in line with, their chest. Pushing the exercise arm forwards into the position of FIG. 4 pushes the connecting link 186 downward, which in turn pushes the user support, causing it to rotate rearward about its pivotal connection 105 to the main frame. The exercise arm and user are rotated during the exercise to produce an exercise path with approximately 10 degrees of arc. This moves the user from a slightly reclined position to a substantially reclined position, ending with their arms extending straight forward and their hands at a slightly higher position relative to their shoulders, as compared with the start position. The handles 110 are therefore positioned forward and above of the start position of FIGS. 1 and 3 when in the end position of FIGS. 2 and 4. As indicated in FIG. 4, the user's arms in the end position extend along a line 119 which is at an angle of around 10 degrees to a line 121 perpendicular to the back pad 102. The pivot arrangement and relative positions of the user support and exercise arm, as well as the arrangement of the connecting link, places the handles 110 automatically in the appropriate start position for a chest press exercise, and produces an appropriate end position as in FIGS. 2 and 4 in which the user's arms tend to be at or close to a suitable end position for a chest press exercise.

In the machine of FIGS. 1 to 4, the connecting link pushes the user support to cause it to rotate rearward. The vertical dotted line 118 in FIGS. 3 and 4 indicates the vertical centerline of the user support pivot axis 105, which is the gravitational centerline of the user performing the exercise. The position of pivot 105 places the centerline 118 rearward of the user's hips and in line with the user's shoulders in the start position of FIG. 3. Thus, the majority of the user starts the exercise in a position forward of the centerline 118, and the user's body rotates rearward through the centerline throughout the exercise, finishing with the centerline bisecting the middle of their torso as in FIG. 4, for a more evenly balanced weight distribution at the end of the exercise. The combined movement of the user support and exercise arm produces a ten degree rise in hand position from the start position, which is similar to the natural arcing pattern of the free barbell bench press exercise, which has the bar traveling in a "chest to chin" exercise motion. At the same time, the exercise machine 180 will be more comfortable and easier for an inexperienced exerciser, guiding the user throughout the movement to follow the desired exercise path.

Proper placement of the user support pivot results in the combined weight of the user and user support being distributed on both sides of gravitational centerline of the user support's pivotal motion, as can be seen in FIGS. 3 and 4. This balanced weight distribution results in a portion of the user and user support being positioned on each side of the gravitational centerline in both the start and finish positions. As the exercise arm is moved, a portion of this combined weight passes through the gravitational centerline, re-distributing the weight. This re-distribution is gradual and continuous throughout the exercise motion and is not noticed by the user.

Starting the exercise with a portion of the combined weight on the directional side (side that the user support travels towards) of the gravitational centerline results in the initial lifting resistance being reduced. Finishing the exercise with a portion of the combined weight on the non-directional side prevents resistance "drop-off" at the end of the exercise. This balanced distribution of user and user support reduces the effect the combined weight has on the exercise resistance, providing counter-balancing and reducing resistance drop-off, and also offsets the weight of the exercise arm, with limited effect on the exercise resistance felt by the user. Because of this, a counter-balancing weight to offset the weight of the exercise arm assembly, as used in some chest press exercise machines in the past, is not necessary. Since the counter-balancing weight is eliminated, rapid arm movement does not tend to cause ballistic movement to the weights.

Figure 5A:
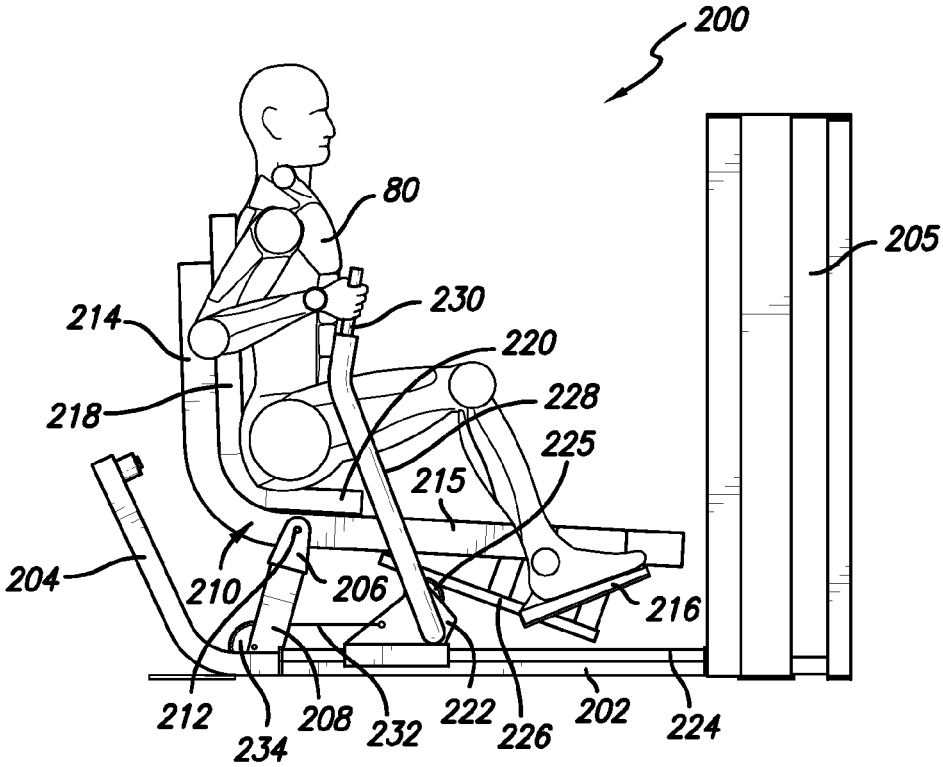
FIG. 5A is a side elevation view illustrating another embodiment of a chest press exercise machine with a seated user in a start position for a decline type chest press exercise.
Figure 5B:
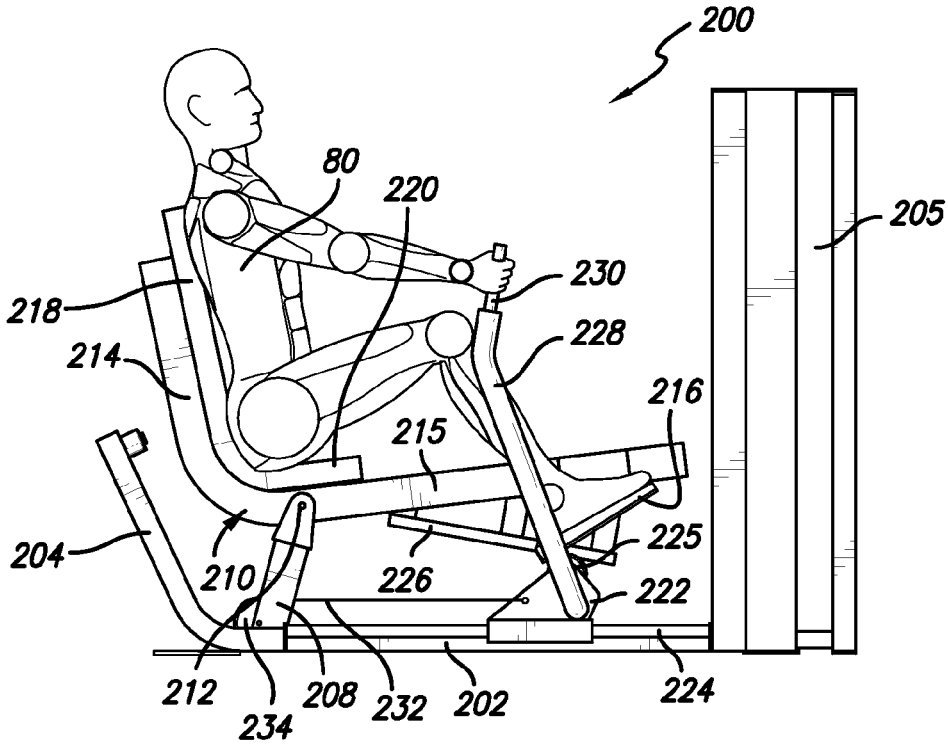
FIG. 5B is a side elevation view of the machine of FIG. 5A illustrating a finish position for the decline press exercise.

FIGS. 5A and 5B illustrate a decline-type chest press machine 200 according to another embodiment. In this example, a main frame has a horizontal base section 202 and an angled, rear vertical section 204, and is connected to a vertical weight stack support frame 205 at its forward end. The weight stack support frame houses a weight stack (not shown) running on two guide rods (also not shown) as is standard in the field. A user support pivot mount or bracket 206 is mounted on top of an upright or post 208 attached to the base section 202 of the main frame. A generally "L" shaped user support 210 is pivotally connected to the main frame at the user support pivot mount 206 for rotation about pivot axis 212. The user support frame 210 has a backrest section 214, an elongated seat section 215 and a footrest 216 mounted at or adjacent the forward end of the seat section. A back pad 218 and seat cushion 220 for positioning an exerciser 80 are mounted on the user support frame. The location of the user support pivot axis 212 in this embodiment is spaced forward from that of the previous embodiment, beneath the seat pad 220 rather than to the rear of the seat pad as in the previous embodiment.

In this machine, a rolling wedge 222 beneath the user support acts as the connecting link that forces rotational movement to the user support. Wedge 222 runs on a pair of guide bars 224 mounted on top of the base section 202 of the main frame and has a roller 225 engaging a single guide bar 226 angularly mounted under the elongated seat section of the user support. A generally "U" shaped exercise arm 228 is fixedly attached to and travels with the wedge in a linear path, rather than a rotational exercise arm path as in the previous embodiment. Arm 228 has opposite portions extending upwardly on opposite sides of the user support, with hand grips 230 at the upper ends of the arm.

In this embodiment, a cable and pulley system connects the elongated wedge 222 and exercise arm 228 with the weight stack to provide resistance. The cable and pulley system includes a cable 232 extending from wedge 222 around a pulley 234 on the base section of the main frame and then forwardly to the weight stack housing, where it may be suitably linked to the upper end of the weight stack by additional pulleys and cables.

FIG. 5A illustrates the start position for a decline press exercise, with the user 80 seated in a generally upright position on the user support and gripping the handles 230 with their arms bent and their hands in front of their chest. As the exercise arm is pushed forward, the rolling wedge travels along bar 226, causing the forward end of the user support to rise and the user support rotate rearward about pivot axis 212 at its pivotal connection to the main frame. FIG. 5B illustrates the finish position for the decline press exercise where the user's arms are extended and inclined slightly downwards, and the seat has rocked back slightly from the position in FIG. 5A. By rotating the user support in response to the linear movement of the exercise arm, this embodiment takes a straight line exercise motion and turns it into an arcing motion which substantially duplicates or is similar to the natural motion found in a corresponding free weight exercise. The rolling wedge design is similar to the one disclosed in U.S. Pat. No. 6,916,278, the contents of which are incorporated herein by reference. The user support in this embodiment is reclined rearwardly in the end position of FIG. 5B, and rotates in the opposite direction to the exercise arm movement.

Figure 6A:
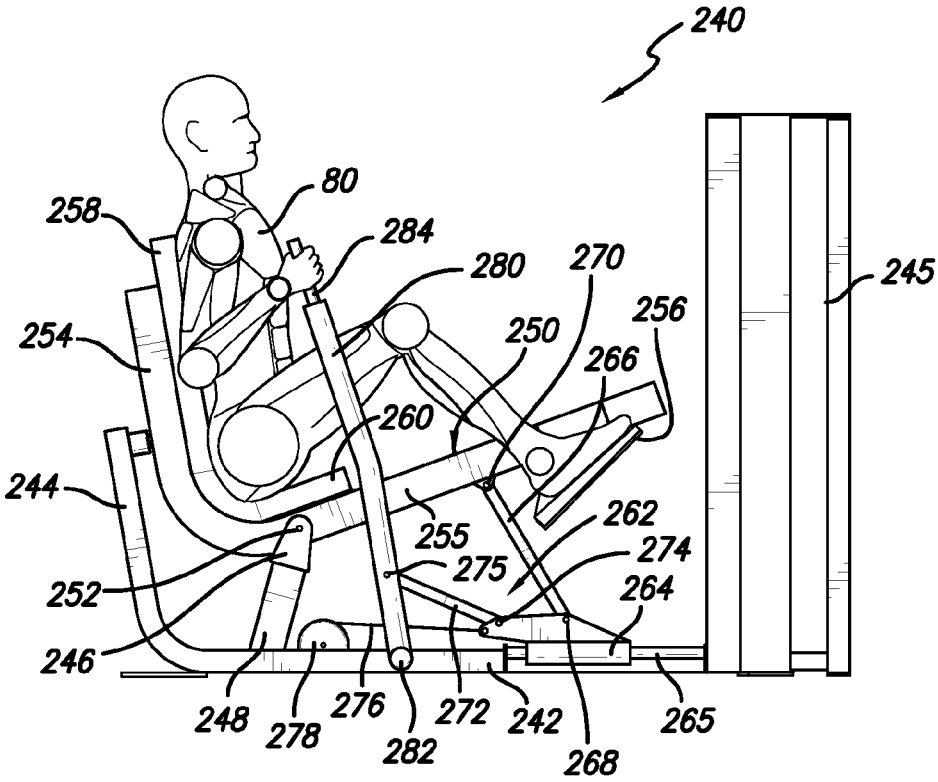
FIG. 6A is a side elevation view of a modified decline press exercise machine according to another embodiment, illustrating an exercise start position.
Figure 6B:
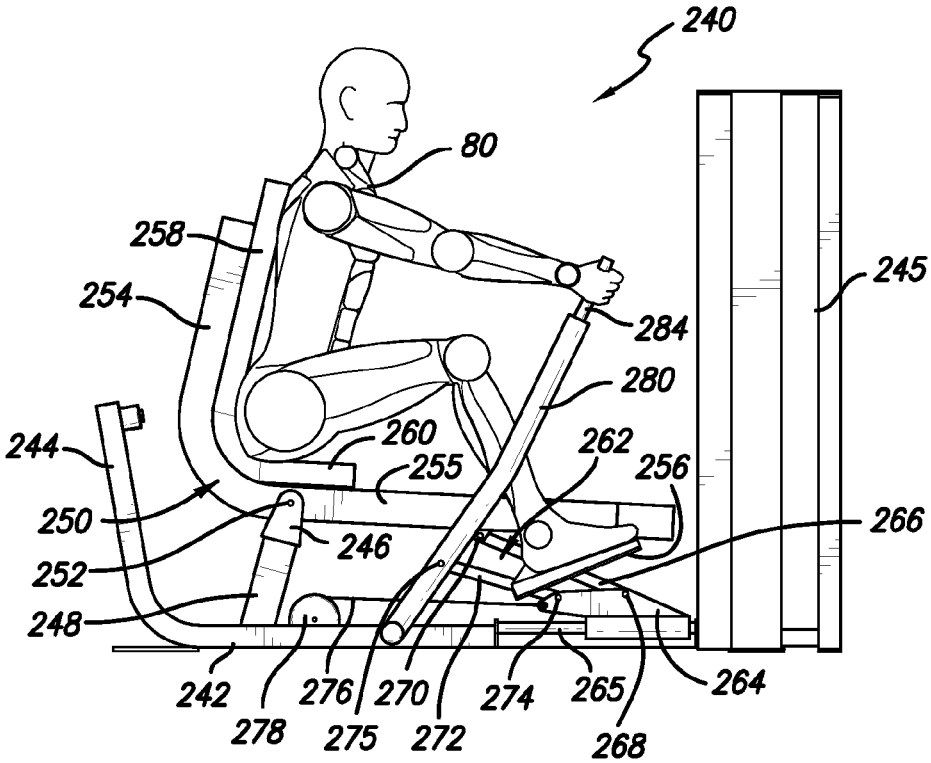
FIG. 6B is a side elevation view similar to FIG. 6A, illustrating an exercise finish position.

FIGS. 6A and 6B illustrate a decline-type chest press exercise machine 240 similar to the machine of the previous embodiment, however this version starts the user in a reclined position and rotates them forward as the exercise arm is moved, whereas the previous embodiment started the user in a more upright position and rotated them rearward into a reclined position. As in the previous embodiment, a main frame has a horizontal base section 242 and an angled, rear vertical section 244, and is connected to a vertical weight stack support frame 245 at its forward end. The weight stack support frame houses a weight stack (not shown) running on two guide rods (also not shown) as is standard in the field. A user support pivot mount or bracket 246 is mounted on top of an upright or post 248 attached to the base section 242 of the main frame. A generally "L" shaped user support 250 is pivotally connected to the main frame at the user support pivot mount 246 for rotation about pivot axis 252, which is in a similar location to the pivot axis of the previous embodiment. The user support frame 250 has a backrest section 254, an elongated seat section 255 and a footrest 256 mounted at or adjacent the forward end of the seat section. A back pad 258 and seat cushion 260 for positioning an exerciser 80 are mounted on the user support frame.

A U-shaped exercise arm 280 is pivotally attached to the base section 242 of the main frame at pivot 282, and has opposite portions extending upwardly on opposite sides of the seat, with handles or grips 284 at its upper end for gripping by a user 80.

This embodiment replaces the rolling wedge of the previous embodiment with a sliding linkage system 262 as the connecting link which is designed to lower the user support as it rotates forward. The sliding linkage system 262 includes a slide 264 running on guide bars 265 mounted to the base section 242 of the main frame, which act as runners for the slide. Any suitable slide member may be used, such as a linear bearing, wheel, or the like. A first linkage bar 266 is pivotally connected at its first end to the slide 264 for rotation about pivot axis 268 and at its second end to the underside of the elongated seat section of the user support frame for rotation about pivot axis 270. A second linkage bar 272 pivotally connects the slide 264 with the exercise arm 280 at pivots 274, 275, respectively. The slide member 264 is linked to the exercise resistance or weight stack via a cable and pulley linkage which includes cable 276 extending rearward from slide member 264 around a pulley 278 on the base section 242 of the frame, and then forward to link to the weight stack.

FIG. 6A illustrates a user 80 in a starting position on machine 240 prior to performing a decline-type chest press exercise. In this position, the user is in a reclined position, and grips the handles 284 with their arms bent and close to their chest. As the exercise arm is rotated forward during the exercise motion, it pushes the slide 264 forward via the second linkage bar 272. As the slide moves forward, the first linkage bar 266 is also pulled forward at its lower end and rotates downwardly at its upper end, pulling the user support downward. Because the exercise arm rotates in a downward arc greater then that of the user support, the result is a similar chest to abdomen exercise motion as a free weight decline type chest press. A portion of the combined user and user support weight is on both sides of the gravitational centerline in both the start and finish positions, helping to balance the forward fall of the user support since it will act as a counterbalance. The sliding linkage design is similar to the one disclosed in U.S. Pat. No. 7,052,444, the contents of which are incorporated herein by reference.

Figure 7A:
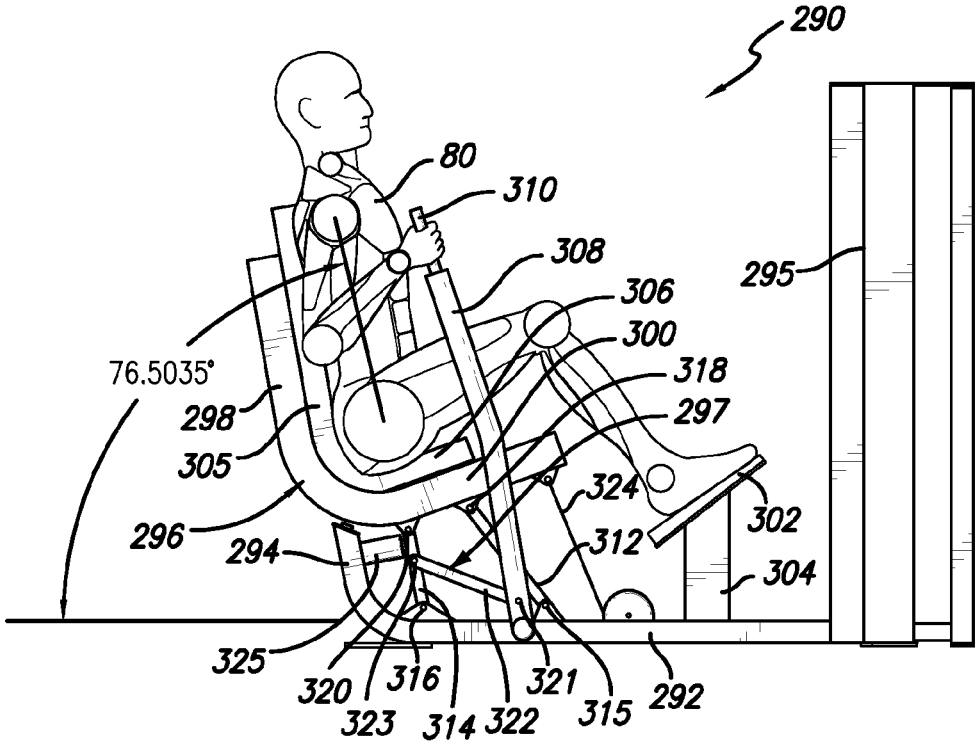
FIG. 7A is a side elevation view of the start position of another embodiment of a decline chest press exercise machine.
Figure 7B:
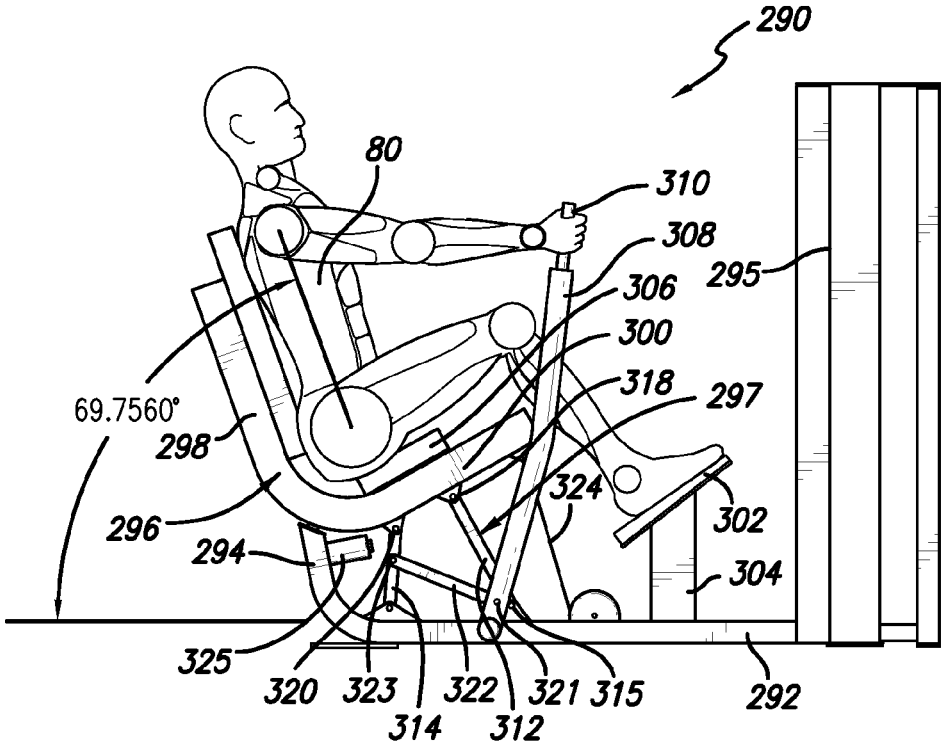
FIG. 7B is a side elevation view similar to FIG. 7A illustrating a finish position of the exercise machine.
Figure 8:
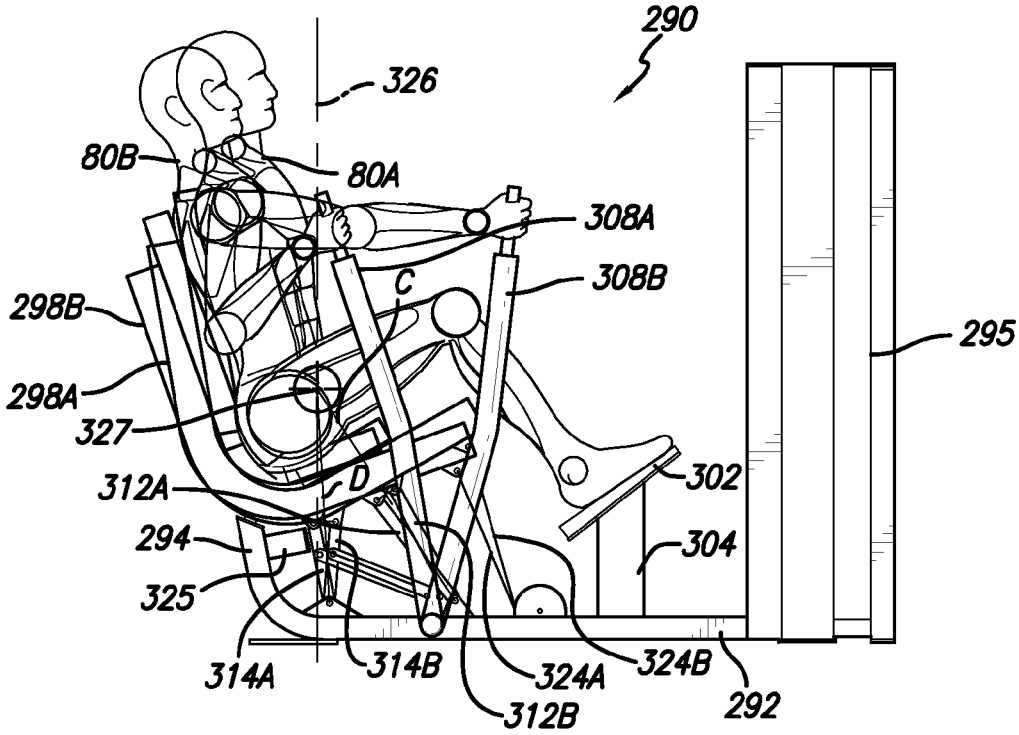
FIG. 8 is a side elevation view of the exercise machine of FIGS. 7A and 7B in which the start and finish positions of the machine and exerciser are superimposed to illustrate the movement of the four bar linkage pivoting system of the user support.

FIGS. 7A, 7B, and 8 illustrate a chest press exercise machine 290 of another embodiment in which the user support is lifted upward and rearward by a four-bar linkage system. Machine 290 is also designed for performing a decline-type chest press, similar to the machines of the previous two embodiments.

As in the previous two embodiments, a main frame has a horizontal base section 292 and an angled, rear upright section 294, although upright section 294 is shorter than in the previous embodiments. The main frame is connected to a vertical weight stack support frame 295 at its forward end. In this embodiment, a generally L-shaped user support 296 is pivotally connected to the main frame by a four-bar linkage system 297 described in more detail below. The user support frame 296 has a backrest section 298 and a seat section 300 which is shorter than the previous embodiments. Unlike the previous embodiments, the footrest 302 in this embodiment is mounted on a stationary post 304 on the frame in front of the user support. Thus, in this embodiment, the foot rest used to support the exerciser's feet is stationary, instead of being a part of the traveling user support. A back pad 305 and seat cushion 306 for positioning an exerciser 80 are mounted on the user support frame.

A "U" shaped-exercise arm 308 is pivotally attached to the base section 292 of the main frame in a similar manner to the previous embodiment, and has user engaging handles or grips 310 at its upper end for gripping by a user 80 when performing exercises on the machine. The four-bar linkage system 297 has spaced first and second linkage bars 312, 314 that run from the top of the base tube or section 292 to the underside of the user support frame. The first linkage bar 312 is longer than and located forward of the second linkage bar 314. The first and second linkage bars 312, 314 are pivoted at one end to the base tube 292 for rotation about spaced first and second pivot axes 315, 316 and are pivoted at the opposite end to the underside of the seat section 300 of the user support for rotation about spaced third and fourth pivot axes 318, 320. A connecting link 322 pivotally joins the exercise arm 308 with the second linkage bar 314 of the user support pivot system via pivots 321, 323. A load, supplied by a cable and pulley system linked to a weight stack, is attached to the user support via a cable 324 to provide resistance for the exercise.

In the rest or exercise start position of FIG. 7A, the user support frame 296 rests on standoff 325 on the inner side of upright 294 which is engaged by pivot mount link 314. To perform the exercise, a user 80 first sits on the user support, places their feet on the stationary foot rest 302, grabs the user engaging handles 310 on the exercise arm 308 with their arms bent and in front of their chest as in FIG. 7A. The user then extends their arms forward in front of their body until they reach the finish position of FIG. 7B. This action rotates the exercise arm 308 forward, and pulls the connecting link 322 forward, which in turn pulls the second linkage bar 314, causing both the first and second linkage bars 312, 314 to move forward. During this movement, the first linkage bar 312 moves in an upward angle while the second linkage bar 314 moves in a downward angle. This combined movement pattern shifts the user support slightly forward while it raises the front end and lowers the rear end of the user support. This results in a rearward rotation of the user support about a theoretical pivot 327 produced by the combined pivoting action of the four-bar pivot linkage 297. The theoretical pivot 327 is illustrated in FIG. 8 and is the position the user support would pivot about if a single pivot were used in order to obtain the same movement pattern. The user support 296 rests on a bumper at the top of frame upright 294 in the finish position of FIG. 7B.

FIG. 8 illustrates the 4-bar linkage pivoting linkage 297 of the machine 290 with the start and finish positions of FIGS. 7A and 7B superimposed. In FIG. 8, start positions of moving parts are indicated by the letter A after their associated reference number, and finish positions are indicated by the letter B after the reference number. Lines C and D are the centerlines of the arcing movement of each linkage bar. The point in space where lines C and D meet forms the theoretical pivot 327 for the user support. A dotted vertical line 326 bisecting this pivot point represents the gravitational centerline for the user support movement. In this embodiment, the rotation of the user support is relatively small (approximately 7 degrees) but is enough so that, combined with the downward arc of the user engaging handle 310, the resulting motion produces the chest to abdomen exercise motion of a decline press.

Figure 9A:
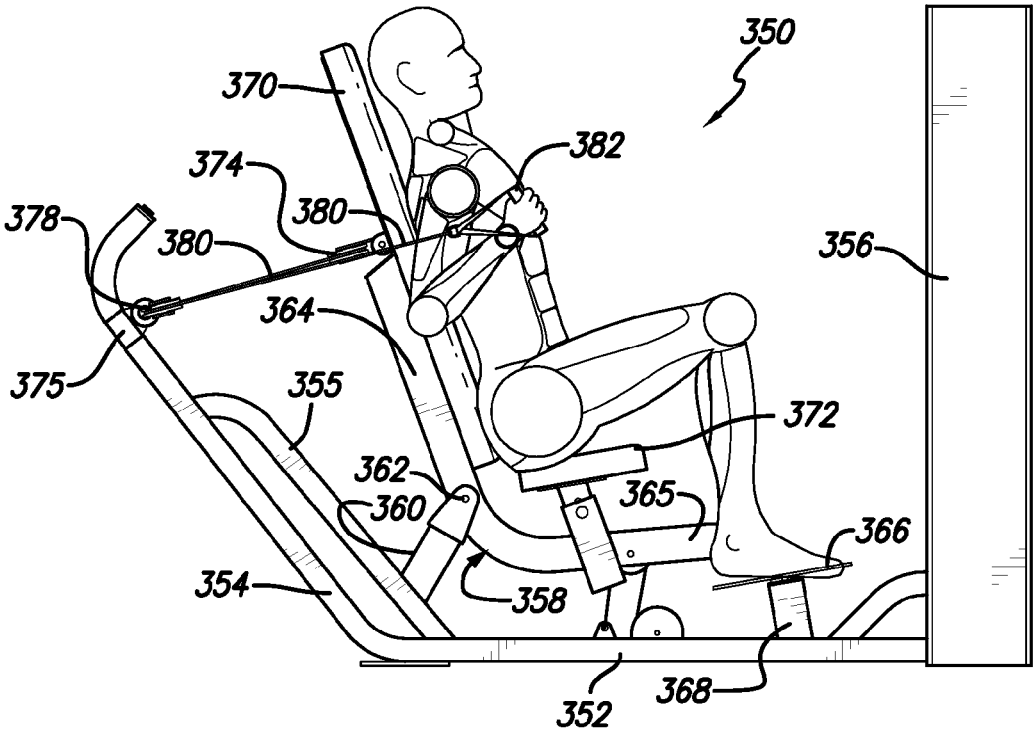
FIG. 9A is a side elevation view illustrating another embodiment of a chest press exercise machine for performing different types of chest press exercise, illustrating an exercise start position.
Figure 9B:
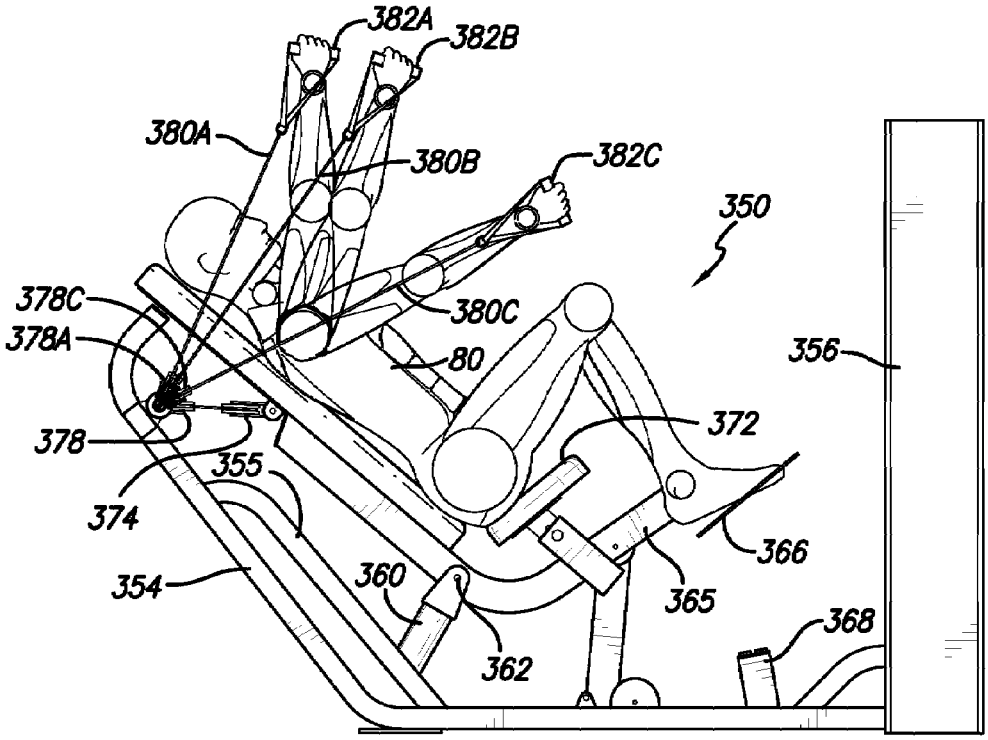
FIG. 9B is a side elevation view similar to FIG. 9A illustrating finish positions for three different types of chest press exercise.
Figure 10:
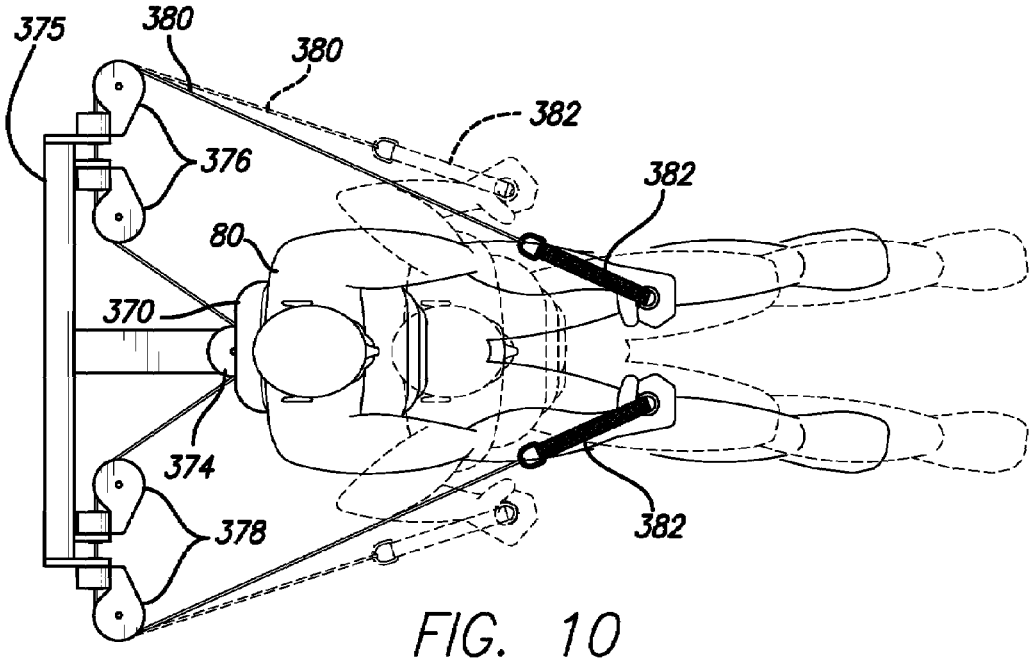
FIG. 10 is a top plan view of the machine of FIGS. 9A and 9B illustrating a possible converging hand movement between the start position and finish position for a chest press exercise.

FIGS. 9A, 9B, and 10 illustrate another embodiment of a chest press exercise machine 350. This version can perform all three variations of the chest press, specifically a decline press, bench press, and incline press. It also allows the user to alter the movement pattern of their hands and perform a converging motion, where the hands start wide apart and finish closer together, instead of the straight line motion found in the other embodiments.

In this embodiment, a main frame has a horizontal base section 352 and an angled, rear upright section 354 with a support brace 355 connecting the upright section to the base section for added support. The main frame is connected to a vertical weight stack support frame 356 at its forward end. A generally L-shaped user support 358 is pivotally connected to a post 360 on the support brace 355 of the main frame for rotation about pivot axis 362, which is in a similar position to the pivot axis of the first embodiment of FIGS. 1 to 4. The user support frame has a backrest section 364 and an extended seat section 365 with a footrest 366 secured at or adjacent the forward end of the seat section. The footrest 366 rests on top of stop post 368 on the base section of the frame when the machine is in the start position of FIG. 9A. An upwardly extending back 370 is mounted on the backrest section 364 of the user support frame, and seat pad 372 is adjustably mounted on the seat section 365 to accommodate different size users.

In this embodiment, a swiveling pulley 374 is pivotally mounted on the back of the backrest section 364 of the user support and forms the connecting link between the user engagement device and user support. A cross tube 375 is mounted transversely in a T-configuration at the upper end of the upright section 354 of the main frame, as best illustrated in FIG. 10. Dual pairs 376, 378 of swiveling pulleys are pivotally mounted at or adjacent opposite ends of the cross tube 375 as indicated. The dual pulleys are mounted at equal distances from the mid-line of the cross tube. All the swiveling pulleys 374, 376, 378 are free pivoting and capable of independent movement. A user engagement device comprising a cable or flexible line 380 extends around the first pair 376 of swiveling pulleys on the main frame, then around the single swiveling pulley or connecting link 374 on the backrest section of the user support, and finally around the second pair 378 of swiveling pulleys. Strap handles 382 are attached to opposite ends of the flexible line or cable 380. The inner pulley of each pair of pulleys 376 and 378 tracks the movement of the central swiveling pulley 374, while the outermost pulley of each pair tracks the movement of the strap handles, as illustrated in FIG. 9B.

To perform an exercise, the user 80 positions themselves as in the other embodiments, brings the handles 382 to chest level as illustrated in FIG. 9A and in dotted outline in FIG. 10, and extends their arms outward. This outward movement is performed at the angle and movement pattern of the user's choice. They can choose to finish with their hands at forehead level to simulate an incline press, as indicated by the handle finish position 382A illustrated in FIG. 9B. Alternatively, they can finish the exercise at the handle finish position 382B of FIG. 9B, with the handles at chin level for a bench press. In order to perform a decline press, the user will finish the exercise with the handles at abdominal level a indicated by the handle finish position 382C of FIG. 9B. The hand movement can be linear or converging as shown in FIG. 10.

The exercise machines of the above embodiments all place the user in a back supported starting position with their hands at chest level. Each supported exercise then follows the slight natural arcing movement of a barbell or dumbbell press and ends with the users arms extended out away from their body at the appropriate position for the exercise. Because the user support moves in conjunction with the exercise arm, the exercise arm's arcuate path relative to the user support is reduced. The result is a more natural feeling exercise movement that more closely replicates the movement found in the corresponding free weight exercise. Because the seat and back pad move together, the user remains properly positioned to the exercise arm with proper back support and does not have to try to maintain their balance.

All of the machines have a user engagement device or exercise arm with a linkage linking movement of the exercise arm to movement of the user support. A load provides resistance to movement of the user support, the exercise arm, and/or the connecting link. Additionally, each design has a primary user support or seat, as well as at least one secondary user support for the feet or another part of the user's body, the secondary support being mounted on the user support in some embodiments, or fixed on the frame in other embodiments. Although the user support in the above embodiments supports a user in a seated position, alternative embodiments may have a user support which supports a user in a standing, prone or kneeling position.

The machines are configured to produce the proper starting and finishing arm/hand positions for the respective chest press exercises because the user support adjusts to the exercise arm position and does not force the user's hands to travel in an exaggerated arc that is greater than that of the natural exercise motion. In most embodiments the exercise arms travel separate from the user support, however the movement of the user support is dependent on and linked to the movement of the exercise arm.

Each of the above embodiments places a portion of the user's body weight (as well as the weight of the user support) on the opposite side of the gravitational centerline from the resistance, which helps to counter-balance or lessen the initial lift (starting resistance). With the combined movement to the user and user support, there is no perceived shift in the combined weight from one side of the gravitational centerline to the other and no noticeable affect on the exercise resistance felt by the user.

It should be understood that all the different elements used in the various embodiments may be mixed and interchanged with one another. The footrest in each embodiment could be stationary or move with the user support; the seat and/or back pad could be fixed or made adjustable; exercise arms could be one piece (dependent) or two-piece (independent), the exercise arms may have rotational or linear movement and can be mounted on the main frame, user support or connecting link. Various types of user engaging handle or grips can be used and they can travel in a fixed movement pattern or one that is user defined. The connecting links could be made adjustable, solid links could be replaced with flexible ones, and the connecting links could be made to push or pull to urge rotation of the user support which can be made to rotate forward or rearward. Any of the various designs could have the resistance associated with any of the moving parts (user support, exercise arm or connecting link).

It should also be noted that other embodiments could use different types and forms of components without affecting the scope of this invention. Cables could be replaced with belts, ropes, chains or the like, pulleys replaced with sprockets and the seat, back pad and/or foot rest could be made adjustable. Other types of resistance know to the art could by used such as hand-loaded weight plates, hydraulic, pneumatic, electromagnetic or elastic bands and still work with the above embodiments.

In the above embodiments, the pivoting seat and backrest (user support) continuously and automatically self-aligns to the movement of an exercise arm throughout the entire exercise motion. This combined movement maintains the ideal alignment relationship between the exerciser, positioned on the user support, and the user engaging means (handles) on the exercise arm.

Each of the above embodiments has a floor engaging main frame; a user support pivot; a user support comprising a user support frame, a seat pad, back rest pad and foot rest; a user engaging exercise arm; a connecting link for linking movement of the exercise arm to movement in the user support frame; and a load for providing resistance to movement of the user support, exercise arm and/or connecting link. The user support is pivotally mounted to the main frame via the user support pivot which may be a single pivot or a multi-part pivot link. The exercise arm is movably mounted to the frame, the user support or the connecting link and has user-engaging handles approximate its outward end. The connecting link is movably associated with the user engagement means (exercise arm and handles for gripping by the user) and at least one of the other elements (main frame, user support or user support pivot), so that movement in the exercise arm translates into movement in the user support.

Proper placement of the user support pivot results in the combined weight of the user and user support being distributed on both sides of gravitational centerline of the user support pivotal motion. This balanced weight distribution results in a portion of the user and user support being positioned on each side of the gravitational centerline in both the start and finish positions. As the exercise arm is moved, a portion of this combined weight passes through the gravitational centerline, redistributing the weight. This re-distribution is gradual and continuous throughout the exercise motion and is not noticed by the user.

Starting with a portion of the combined weight on the directional side (side that the user support travels towards) of the gravitational centerline results in the initial lifting resistance being reduced. Finishing the exercise with a portion of the combined weight on the non-directional side prevents or reduces resistance "drop-off" at the end of the exercise. This balanced distribution of user and user support reduces the effect the combined weight has on the exercise resistance.

By linking movement of the user support to movement of the exercise arm and positioning the user support pivot so that the combined weight of the user support and user is distributed on both sides of the pivot's gravitational centerline, the user support provides a counter-balancing effect on the exercise arm as it moves and its weight is re-distributed. This may avoid the need to add a heavy solid-weight for counterbalance on the outboard end of the exercise arm. The user support acts to counter-balance the exercise arm, so that rapid arm movement is less likely to cause ballistic movement to the weights.

The rocking movement of the user support in each of the above embodiments can make the exercise more fun to perform. Repetitious exercise movement can be tedious and boring. By adding motion to the user support, performing the exercise may be more enjoyable and the user's interest in their workout may increase. This is a benefit to both the individual user, who will exercise more regularly, and the fitness facility, where retention of members is a primary objective.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary portion supporting the majority of the user's weight in the start position of the user support and the secondary portion being fixed at a predetermined angular orientation relative to the primary portion, whereby the primary and secondary portions travel together in the same relative orientation to one another throughout the exercise movement;

a user engagement device movably mounted relative to the main frame and having at least one handle for gripping by a user positioned on the user support, the handle being movable relative to the user support during a chest press exercise movement between a start position in which the handle is located at a first position in front of a user's chest when positioned on the user support at the start of a chest press exercise, and an end position extended outward from the first position at the end of a chest press exercise;

a connecting link which links movement of the user engagement device to movement of the user support;

a load which resists movement of at least one of the user support, user engagement device, and connecting link;

the user support pivot axis defining a vertical gravitational center line of the pivotal movement of the user support, the user support pivot axis being positioned at a predetermined location such that portions of the combined weight of the user and user support are distributed on each side of the gravitational center line at the start and end of a chest press exercise movement;

whereby the combined motion of the user, user support, and user engagement device substantially replicates the natural movement of the upper part of a human body when performing a free weight chest press exercise.

2. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary and secondary portions being fixed relative to one another and moving together in the same relative orientation to one another throughout the exercise movement;

a user engagement device movably mounted relative to the main frame and having at least one handle for gripping by a user positioned on the user support, the handle being movable during a chest press exercise movement between a start position in which the handle is located at a first position in front of a user's chest when positioned on the user support, and an end position extended outward from the first position;

a connecting link which links movement of the user engagement device to movement of the user support;

a load which resists movement of at least one of the user support, user engagement device, and connecting link; and exercise movement of the user engagement device in a first direction simultaneously rotating the user support in a direction generally opposite to the first direction;

whereby the combined motion of the user, user support, and user engagement device substantially replicates the natural movement of the upper part of a human body when performing a free weight chest press exercise.

3. The machine of claim 1, wherein the primary portion of the user support comprises a seat portion which supports a user in a seated position, and the secondary portion comprises a backrest portion.

4. The machine of claim 1, further comprising a footrest portion which is secured at a fixed position on the user support for supporting a user's feet during an exercise, the footrest portion moving together with the seat and backrest portions at the same orientation relative to the seat and backrest portions during an exercise movement.

5. The machine of claim 1, wherein the handle is positioned in front of an upper part of the backrest portion in the handle start position at the start of a chest press exercise.

6. The machine of claim 1, wherein the end position of the user support after completion of a chest press exercise movement is rearwardly reclined relative to the start position prior to a chest press exercise movement.

7. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary and secondary portions being fixed relative to one another and moving together in the same relative orientation to one another throughout the exercise movement;

a user support pivot mount comprising a four bar linkage between the user support and main frame, the four bar linkage defining a theoretical pivot axis of the user support pivotal movement;

a user engagement device movably mounted relative to the main frame and having at least one handle for gripping by a user positioned on the user support, the handle being movable during a chest press exercise movement between a start position in which the handle is located at a first position in front of a user's chest when positioned on the user support, and an end position extended outward from the first position;

a connecting link which links movement of the user engagement device to movement of the user support; and a load which resists movement of at least one of the user support, user engagement device, and connecting link;

whereby the combined motion of the user, user support, and user engagement device substantially replicates the natural movement of the upper part of a human body when performing a free weight chest press exercise.

8. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary and secondary portions being fixed relative to one another and moving together in the same relative orientation to one another throughout the exercise movement;

the primary portion of the user support comprising a seat portion which supports a user in a seated position, and the secondary portion comprising a backrest portion;

the user support being pivotally mounted relative to the main frame for rotation about the user support pivot axis, the user support pivot axis being located beneath the seat portion of the user support;

a user engagement device movably mounted relative to the main frame and having at least one handle for gripping by a user positioned on the user support, the handle being movable during a chest press exercise movement between a start position in which the handle is located at a first position in front of a user's chest when positioned on the user support, and an end position extended outward from the first position;

a connecting link which links movement of the user engagement device to movement of the user support; and a load which resists movement of at least one of the user support, user engagement device, and connecting link;

whereby the combined motion of the user, user support, and user engagement device substantially replicates the natural movement of the upper part of a human body when performing a free weight chest press exercise.

9. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary and secondary portions being fixed relative to one another and moving together in the same relative orientation to one another throughout the exercise movement;

the primary portion of the user support comprising a seat portion which supports a user in a seated position, and the secondary portion comprising a backrest portion;

the user support being pivotally mounted relative to the main frame for rotation about a user support pivot axis, the user support pivot axis being located rear of the seat portion of the user support;

a user engagement device movably mounted relative to the main frame and having at least one handle for gripping by a user positioned on the user support, the handle being movable during a chest press exercise movement between a start position in which the handle is located at a first position in front of a user's chest when positioned on the user support, and an end position extended outward from the first position;

a connecting link which links movement of the user engagement device to movement of the user support; and a load which resists movement of at least one of the user support, user engagement device, and connecting link;

whereby the combined motion of the user, user support, and user engagement device substantially replicates the natural movement of the upper part of a human body when performing a free weight chest press exercise.

10. The machine of claim 1, wherein the user engagement device is movably mounted on the user support.

11. The machine of claim 1, wherein the user engagement device is movably mounted on the main frame.

12. The machine of claim 1, wherein the user engagement device comprises at least one rigid arm.

13. The machine of claim 1, wherein the user engagement device comprises at least one flexible, non-resilient member associated with the frame at a location rear of the user support and at least one handle connected to the flexible member.

14. The machine of claim 13, wherein the flexible member has first and second end portions and is associated with the frame between the first and second end portions, a first handle connected to the first end portion and a second handle connected to the second end portion, whereby a user can grip the handles on opposite sides of the user support at selected heights in front of the user for selective performance of decline, bench, and incline chest press exercises.

15. The machine of claim 14, wherein the connecting link comprises a first pivot link on the rear of the user support, and a central portion of the flexible member is associated with the pivot link, the first and second end portions extending in opposite directions from the first pivot link up to the first and second handle, respectively, the frame having horizontally spaced second and third pivot links and the first and second end portions extending around the second and third pivot link, respectively.

16. The machine of claim 1, wherein the connecting link is a rigid link.

17. The machine of claim 1, wherein the connecting link has a first end pivoted to the user support and a second end pivoted to the user engagement means.

18. The machine of claim 1, wherein the connecting link is a flexible link.

19. The machine of claim 1, wherein the connecting link comprises a moving wedge member slidably engaged with the main frame and the user support, and the user engagement device is mounted on the moving wedge member.

20. The machine of claim 1, wherein the connecting link comprises a sliding linkage system having a sliding member slidably mounted on the main frame, a first link having a first end pivoted to the sliding member and a second end pivoted to the user support, and a second link having a first end pivoted to the sliding member and a second end pivoted to the user engagement device.

21. The machine of claim 1, wherein the user engagement device is rotatably mounted for movement in a rotational path between the start and end position of a chest press exercise.

22. The machine of claim 1, wherein the user engagement device is movably mounted for linear movement between the start and end position of a chest press exercise.

23. A chest press exercise machine, comprising:

a main frame having a front end and a rear end;

a user support pivotally mounted relative to the main frame to support a user in an exercise position and moving about a user support pivot axis between a start position and an end position during a chest press exercise movement, the user support having a primary portion and a secondary portion which support spaced positions on a user's body throughout an exercise, the primary and secondary portions being fixed relative to one another and moving together in the same relative orientation to one another throughout the exercise movement;

a user engagement device movably mounted relative to the main frame and having at least one handle for gripping by a user positioned on the user support, the handle being movable between a start position at the start of a chest press exercise in which the handle is located at a first position in front of a user's chest when positioned on the user support, and an end position at the end of a chest press exercise in which the handle is extended outward from the first position, the end position of the handle being located forward and upward from the start position of the handle;

a connecting link which links movement of the user engagement device to movement of the user support; and a load which resists movement of at least one of the user support, user engagement device, and connecting link;

whereby the combined motion of the user, user support, and user engagement device substantially replicates the natural movement of the upper part of a human body when performing a free weight chest press exercise.

24. The machine of claim 1, wherein the end position of the handle is aligned with a lower position relative to the user support than the start position of the handle.

* * * * *